US012343615B2

(12) United States Patent
Miller

(10) Patent No.: US 12,343,615 B2
(45) Date of Patent: Jul. 1, 2025

(54) SKATEBOARD TRUCK WITH FRICTION BUSHING

(71) Applicant: Brad Miller, Westlake, OR (US)

(72) Inventor: Brad Miller, Westlake, OR (US)

( * ) Notice: Subject to any disclaimer, the term of this patent is extended or adjusted under 35 U.S.C. 154(b) by 389 days.

(21) Appl. No.: 18/092,319

(22) Filed: Jan. 1, 2023

(65) Prior Publication Data

US 2024/0216785 A1 Jul. 4, 2024

(51) Int. Cl.
*A63C 17/01* (2006.01)

(52) U.S. Cl.
CPC ..... *A63C 17/012* (2013.01)

(58) Field of Classification Search
CPC ..... A63C 17/012; A63C 17/1427
See application file for complete search history.

(56) References Cited

U.S. PATENT DOCUMENTS 4,295,547 A * 10/1981 Dungan ..... A63C 17/1427 188/72.4
8,978,835 B1 * 3/2015 Larock ..... A63C 17/1409 280/11.205
9,120,005 B2 9/2015 Hansen
2009/0256325 A1 * 10/2009 Dickie ..... A63C 17/22 280/87.042

* cited by examiner

*Primary Examiner* — Bryan A Evans
(74) *Attorney, Agent, or Firm* — Robert A. Pasic

(57) ABSTRACT

A truck for a skateboard which includes a friction device is disclosed. The truck includes features used to increase and decrease rolling resistance of a skateboard. The friction device includes a bushing, a wheel and a clamping device. The clamping device determines the axial tension on a bushing which may be elastic.

17 Claims, 12 Drawing Sheets

SKATEBOARD TRUCK WITH FRICTION BUSHING

CROSS-REFERENCE TO RELATED APPLICATIONS

Not applicable

STATEMENT REGARDING FEDERALLY SPONSORED RESEARCH OR DEVELOPMENT

Not applicable

NAMES OF PARTIES TO A JOINT RESEARCH AGREEMENT

Not applicable

BACKGROUND

The present technology is directed to skateboard truck devices. Skateboards have evolved into several different disciplines such as trick, to vert, to high speed downhill skating and as a form of exercise and transportation. The present apparatus may be used to help a rider learn how to control the skateboard. Specifically, a property of a skateboard may include friction of the wheel bearings. The skateboard bearings allow the skateboard to roll freely. This free rolling motion of the wheels may not be an advantage to an operator that is just learning how to ride or is trying to learn skateboard tricks. The operator of a skateboard may push the skateboard with one foot while standing on the skateboard with the other foot. If the operator is not well trained the skateboard may get out of control and cause the operator to fall. In other cases the operator may be trying to learn a trick. A skateboard with wheels that turn freely may cause the operator to lose control of the skateboard and fall. Some tricks require the operator to land on the skateboard. During the landing operation it is critical that the operator land on the skateboard such that the skateboard does not move out from under the operator.

The present technology includes features that decrease free spinning of the skateboard wheels. By increasing the friction between the wheel and the axle of the skateboard, the skateboard is more easily controlled while learning new operations or tricks.

SUMMARY

According to some examples, the present technology is directed to a skateboard truck that is easily to control due to increased friction of the wheels among other advancements. In some examples, the skateboard truck may include geometry that allows for easy adjustment of wheel friction. For example some examples include a friction device comprising a wheel bushing that is constructed of a single elastomeric piece. In other examples the geometry of the bushing allows for easier adjustment of friction. In some examples a tensioning device is included to axially load the bushing and allow for friction adjustment.

The present technology addresses the need for adjustable wheel friction with a friction device located within the wheel, axle connection. Broadly a skateboard truck is disclosed.

In some examples the skateboard truck includes a bushing positioned to turn with the wheel and slide or rub against a static feature. In these examples, the outer periphery of the bushing may be rigidly connected to the wheel and the sliding surface is static relative to the wheel. The static feature in these examples may be an axle of the skateboard truck or a shaft spacer located on the axle. In other examples the static feature may be the axle supporting the wheel.

In some examples the skateboard truck includes a bushing attached rigidly to the axle and slides or rubs against a feature rotating with the wheel. In these examples, the rotating feature may be an internal bore of the wheel and the outer periphery of the bushing may be the sliding or rubbing surface in contact with the internal bore of the wheel. In other examples the rotating feature may be a shoulder located on the wheel and the end of the bushing may be the sliding or rubbing surface in contact with the shoulder located on the wheel.

In some examples, the bushing is cylindrical and includes a round periphery, two ends that are parallel and a hole from one end to the other. In other examples, the bushing may have at least one beveled end. This beveled end may have the effect of decreasing the bushing stiffness so that when loaded axially it may be compressed more. This decreased stiffness allows for easier adjustment as more tensioning displacement causes less increase in friction. When adjusting the friction more axial displacement allows the operator to adjust the friction with more precision.

DETAILED DESCRIPTION

Figure 1:
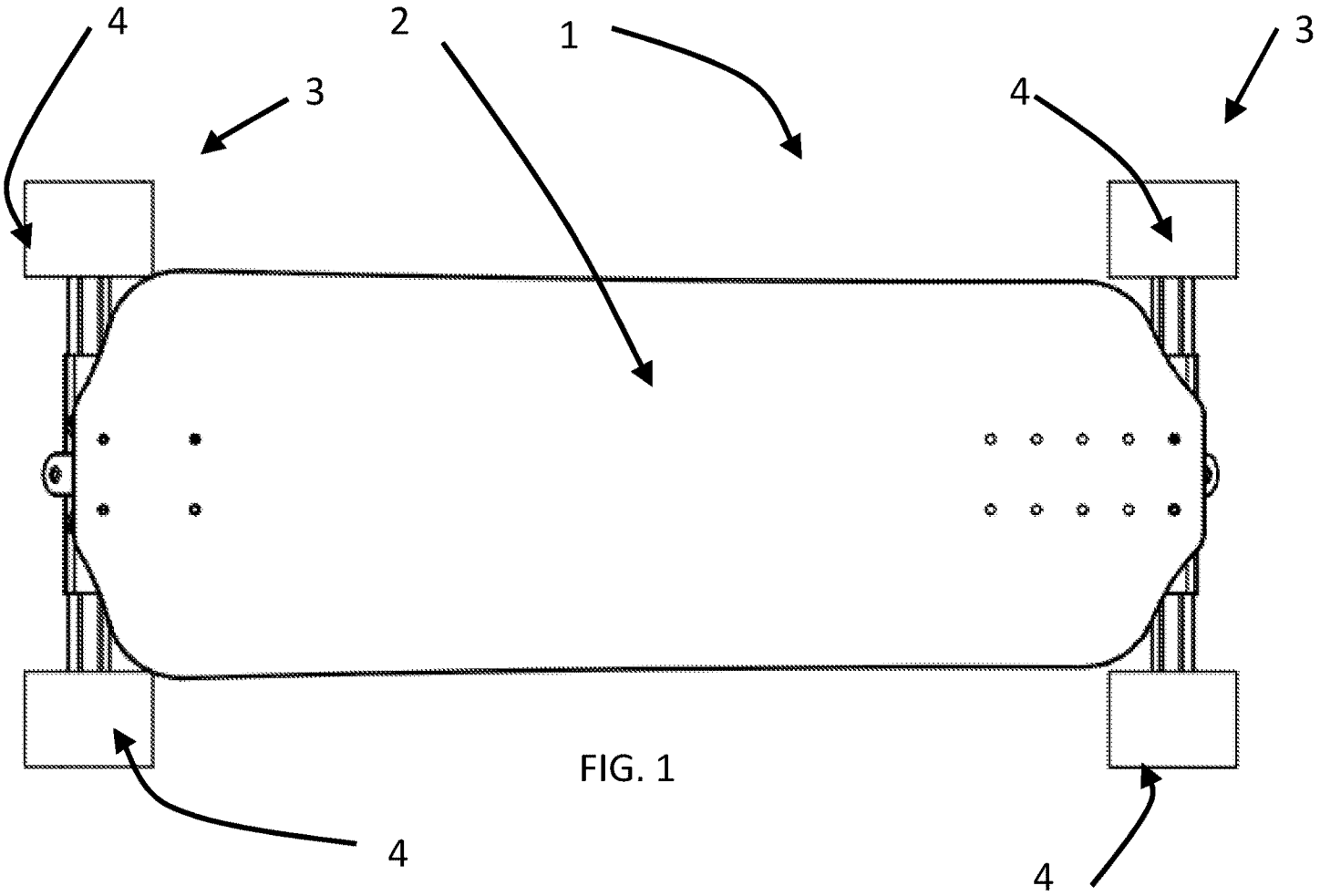
FIG. 1 depicts a top view of a skateboard.

Various aspects and examples of a skateboard truck, as well as related methods, are described below and illustrated in the associated drawings. Unless otherwise specified, a skateboard truck in accordance with the present teachings, and/or its various components, may contain at least one of the structures, components, functionalities, and/or variations described, illustrated, and/or incorporated herein in connections with the present teachings may be included in other similar devices and methods, include being interchangeable between disclosed examples. The following description of various examples is merely illustrative in nature and is in no way intended to limit the disclosure, its application, or uses. Additionally, the advantages provided by the examples and examples described below are illustrative in nature and not all examples provide the same advantages or the same degree of advantages.

This Detailed Description includes the following sections, which follow immediately below: (1) Definitions; (2) Overview; (3) Examples; (4) Advantages, Features, and Benefits; and (5) Conclusion.

Definitions

The following definitions apply herein, unless otherwise indicated.

"Comprising," "including," and "having" (and conjugations thereof) are used interchangeably to mean including but not necessarily limited to, and are open-ended terms not intended to exclude additional unrecited elements, or method steps.

Terms such as "first," "second," and "third" are used to distinguish or identify various members of a group, or the like, and are not intended to show serial or numerical limitations.

"AKA" means "also known as," and may be used to indicate an alternative or corresponding term for a given element or elements.

The terms "inboard," "outboard," "forward," "rearward," and the like are intended to be understood in the context of a host vehicle on which systems described herein may be mounted or otherwise attached. For example, "outboard" may indicate a relative position that is laterally farther from the centerline of the vehicle, or a direction that is away from the vehicle centerline. Conversely, "inboard" may indicate a direction toward the centerline, or a relative position that is closer to the centerline. Similarly, "forward" means toward the front portion of the vehicle, and "rearward" means toward the rear of the vehicle. In the absence of a host vehicle, the same directional terms may be used as if the vehicle were present. For example, even when viewed in isolation, a device may have a "forward" edge, based on the fact that the device would be installed with the edge in question facing in the direction of the front portion of the host vehicle.

"Coupled" means connected, either permanently or releasably, whether directly or indirectly through intervening components.

"Resilient" describes a material or structure configured to respond to normal operation loads (e.g. when compressed) by deforming elastically and returning to an original shape or position when unloaded.

"Rigid" describes a material or structure configured to be stiff, non-deformable, or substantially lacking in flexibility under normal operation conditions.

"Elastic" describes a material or structure configured to spontaneously resume is former shape after being stretched or compressed.

"Providing," in the context of a method, may include receiving, obtaining, purchasing, manufacturing, generating, processing, preprocessing, and/or the like, such that the object or material provided is in a state and configuration for other steps to be carried out.

"Operatively," describes a connection between two devices or entities such that a function is provided from one entity to another. For example, a first entity may be operatively connected to a second entity for transferring force. In this example, a connection between first and second entity may be by gears, a belt, solder, or weld such that force (or torque) is transferred from first entity to second entity.

"Force," and "torque," in this disclosure includes positive and negative values. For instance, force provided to object one from object two means, object one pushes or pulls on object two and/or object two pushes or pulls on object one.

"Stress," in this disclosure refers to force acting on any infinitesimal area located inside a load carrying member divided by the infinitesimal area. The direction of force relative each infinitesimal area determines the type of stress. "Tensile stress" refers to the stress acting perpendicular away from the infinitesimal area. "Compressive stress" refers to the stress acting perpendicular and into the infinitesimal area. "Shear stress" refers to the stress acting parallel to the infinitesimal area. Tensile stress in a negative direction is compressive stress. "Normal stress" refers to both tensile stress and compressive stress, for example a member may carry tensile stress or compressive stress depending on external loads. In this case the member carries normal stresses.

In this disclosure, one or more publication, patents, and/or patent application may be incorporated by reference. However, such material is only incorporated to the extent that no conflict exists between the incorporated material and the statements and drawings set forth herein. In the event of any such conflict, including any conflict in terminology, the present disclosure is controlling.

OVERVIEW

Generally, the present disclosure pertains to devices and methods for a skateboard truck. A skateboard truck is used to support a skateboard board on which an operator is positioned. Features included in a skateboard truck include wheels which allow the skateboard to travel along a rigid surface such as the ground or other rigid structure.

Wheels included in a skateboard truck may provide very little friction while in use. In fact this is a goal for most skateboard use. Ball bearings are typically used to allow the skateboard wheels to roll with little friction. However, in some cases the operator may desire more friction than the bearings provide.

When an operator is learning how to operate a skateboard, friction can have an advantage. The operator needs to push the skateboard so that it translates due to wheel rotation. While pushing the operator needs to compensate for the pushing force by adjusting the operator's body weight. This can cause the skateboard to roll out from under the operator causing the operator to fall. Additionally, many skateboard tricks require landing on the skateboard as it is translating. During landing the operator needs to make sure the skateboard is not pushed out from underneath the operator. In order to help the operator learn to operate a skateboard and to learn tricks a safer skateboard is needed.

The present technology provides a safer skateboard by adding friction to the rolling action of the wheels. This provides the operator a skateboard that is less susceptible to rolling out from underneath the operator.

EXAMPLES, COMPONENTS, AND ALTERNATIVES

The following sections describe selected aspects of illustrative skateboard trucks with a friction device, as well as related systems and/or methods. The examples in these sections are intended for illustration and should not be interpreted as limiting the scope of the present disclosure.

Each section may include one or more distinct embodiments or examples, and/or contextual or related information, function, and/or structure.

Figure 2:
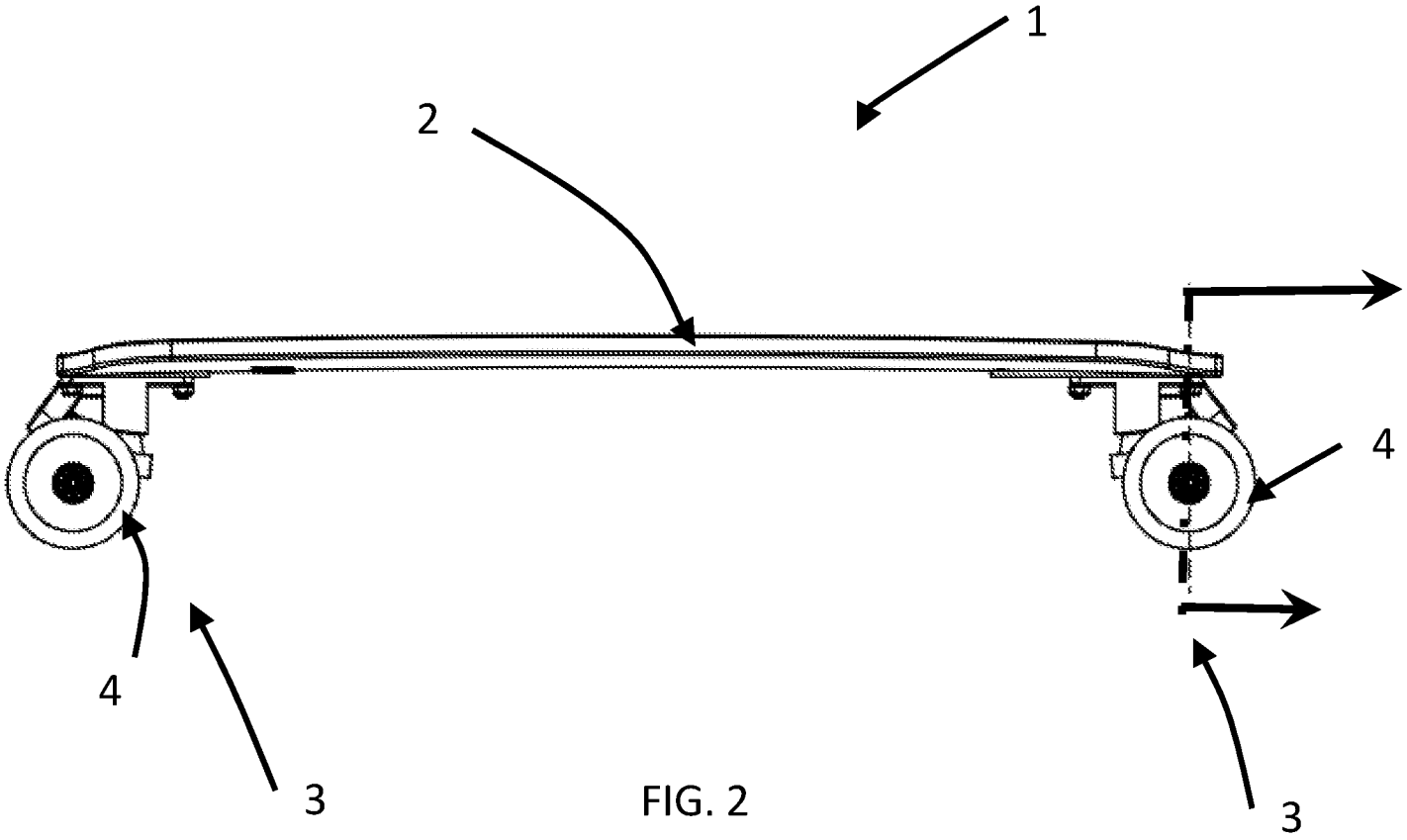
FIG. 2 depicts a side view of a skateboard.

FIGS. 1 and 2 show skateboard 1. Skateboard 1 comprises a board 2 which an operator typically stands on. Board 2 is attached to trucks 3 at the forward and rearward ends of board 2. Trucks 3 may or may not be identical but wheels 4 are included on trucks 3 and allow translation of skateboard 1. Skateboard 1 is supported by wheels 4. Trucks 3 may include a friction device.

Figure 3:
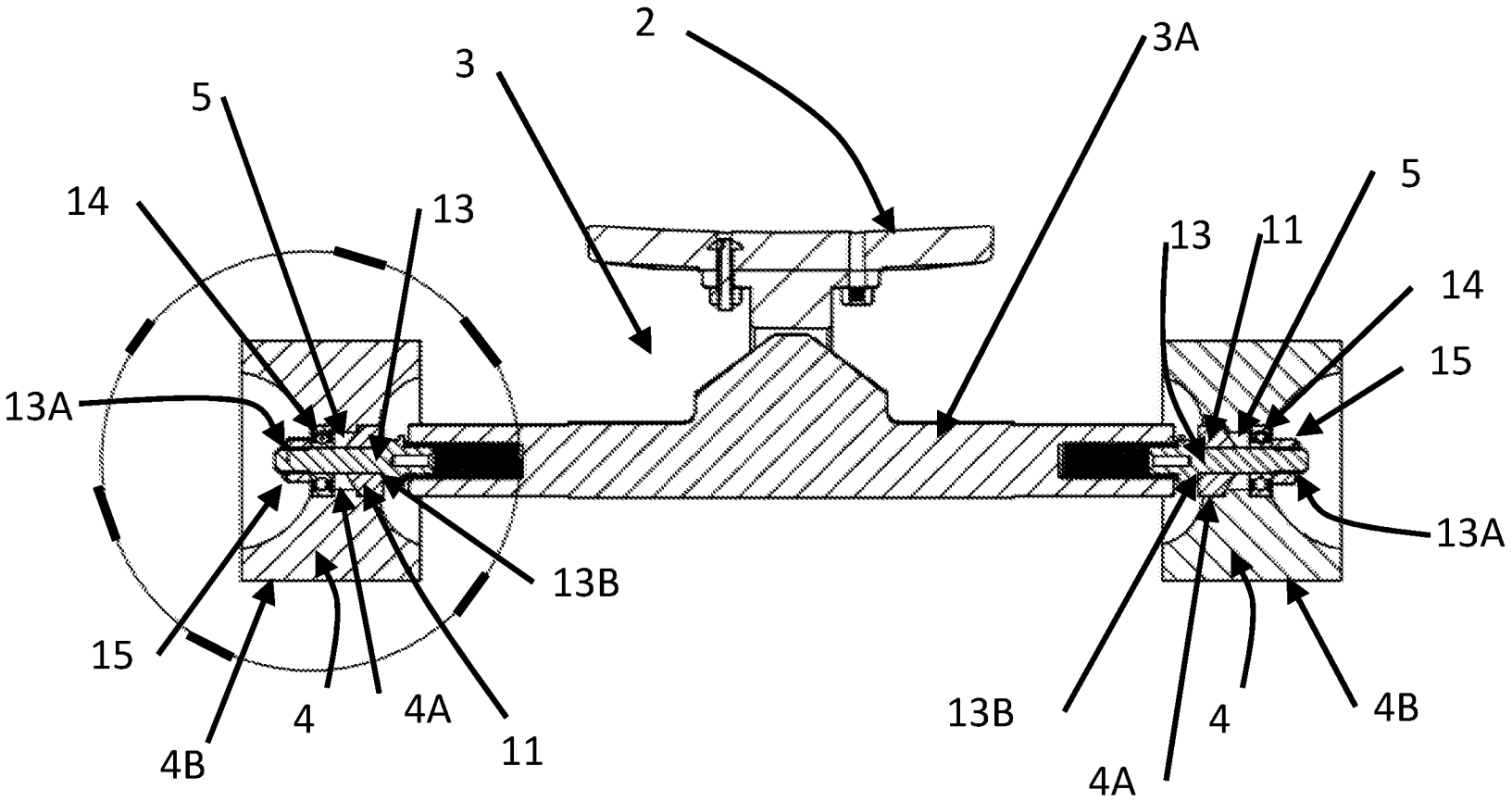
FIG. 3 depicts the cross section view indicated in FIG. 2 with a beveled bushing.

FIG. 2 depicts a side view of skateboard 1. A section view is located through the center of wheel 4. This section view is depicted in FIG. 3. Friction device 5 is depicted in FIG. 3. Friction device 5 may be implemented by several different examples.

A: Illustrative Friction Truck with Beveled Bushing

As shown in FIGS. 3, 3A, 3B, 3C and 4, this section depicts a friction device 5 for use in skateboard truck 3. Referring to FIG. 3 friction device 5 comprises a bearing 14, a bushing 11 and an axle feature 13. Axle feature 13 may include a nut 15 on each end or on one end. Axle feature 13 may include a threaded feature 13A. Axle feature 13 may be a part of hanger 3A or a separate part. Friction device 5 allows rotation of wheel 4 relative to hanger 3A.

In some examples of friction device 5, bearing 14 is located in wheel bore 4D. Wheel bore 4D may be located at the central axis 16 of wheel cylindrical periphery 4B. Bushing 11 is located in wheel bore 4A. Wheel bore 4A may be located at the central axis 16 of wheel periphery 4B. Axle feature 13 may include a threaded end feature 13*a* or a stop feature. Axle feature 13 may also include a face feature 13B which locates friction device 5 axially along axle feature 13. Friction device 5 provides resistance as wheel 4 rotates around axle feature 13 while supporting board 2. This resistance can be adjusted by clamping friction device 5 along the central axis 16.

Figure 3B:
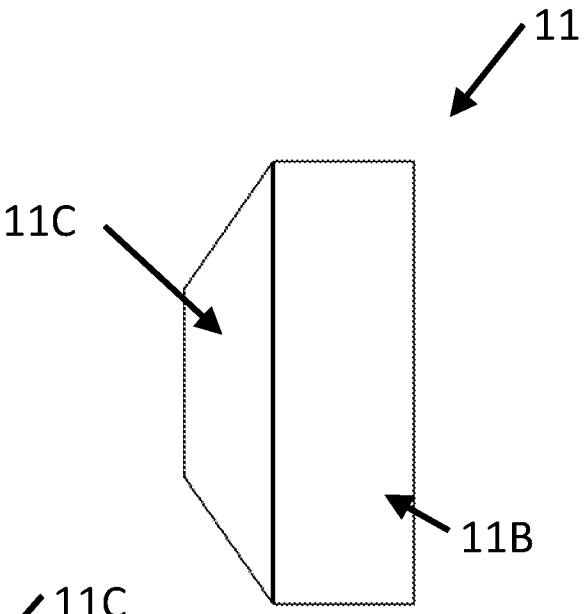
FIG. 3B depicts a side view of a beveled bushing.
Figure 3C:
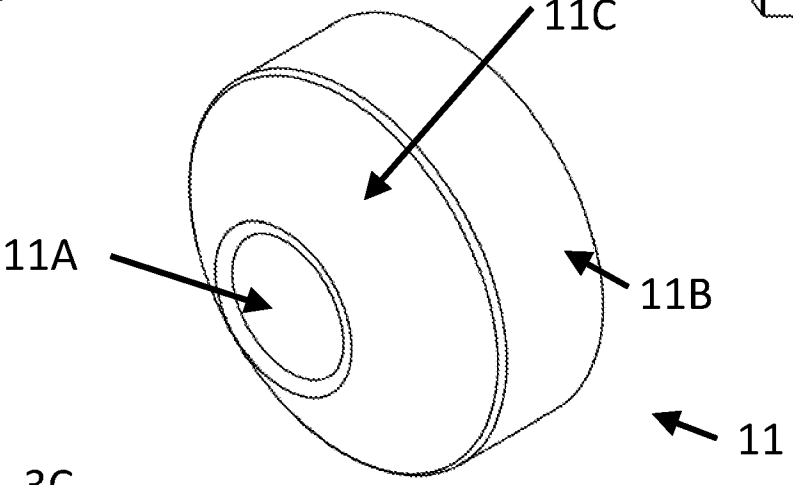
FIG. 3C depicts an isometric view of a beveled bushing.
Figure 3A:
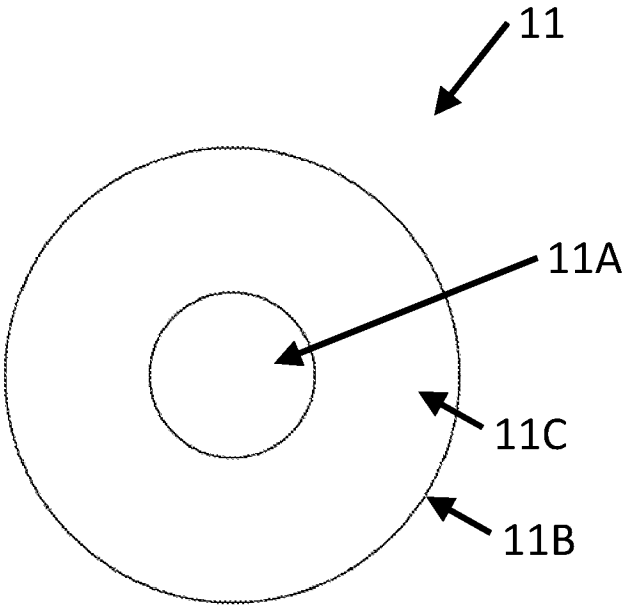
FIG. 3A depicts a front view of a beveled bushing.
Figure 4:
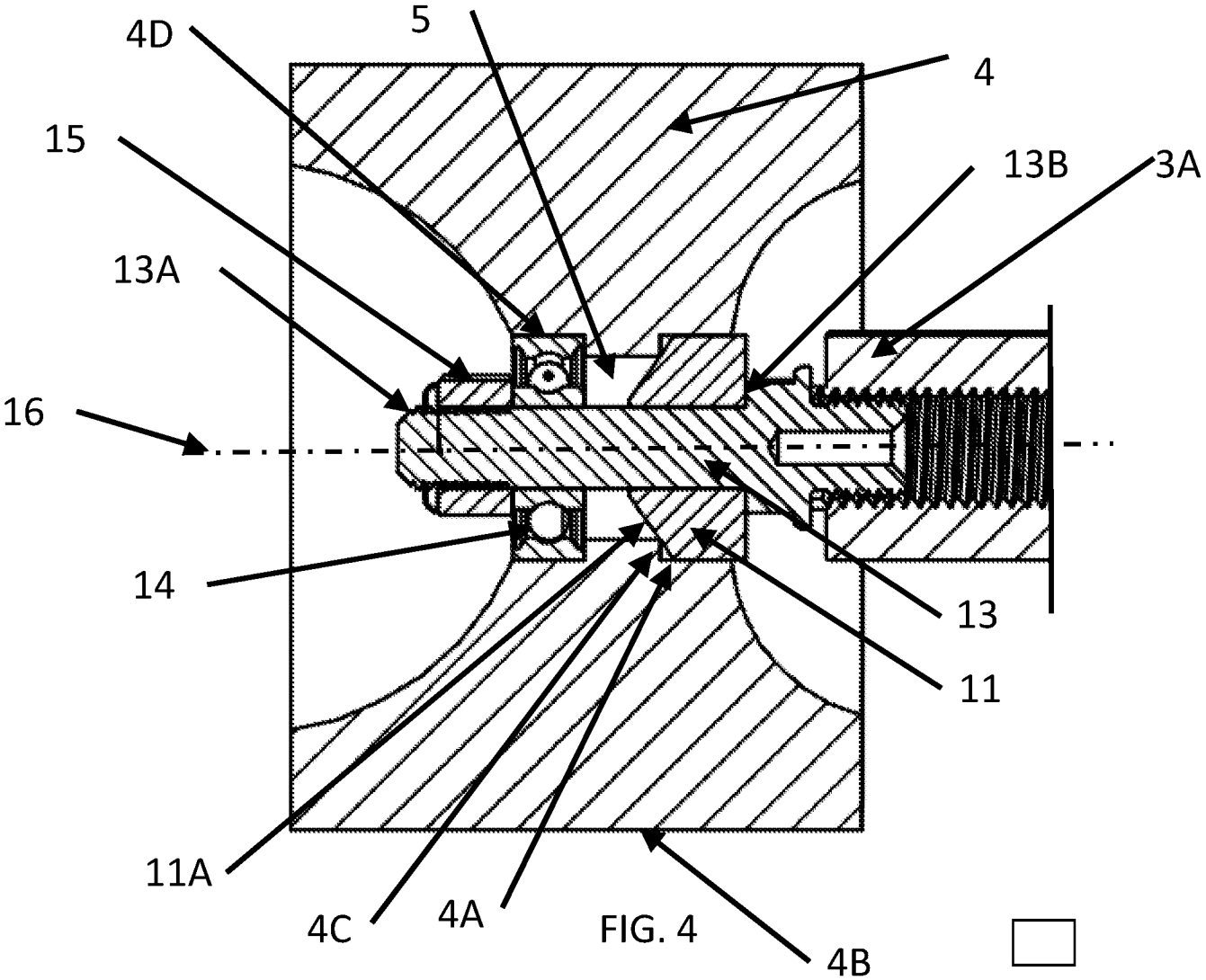
FIG. 4 depicts an enlarged detail indicated in FIG. 3.

Adjusting resistance of friction device 5 is a result of several variables including bushing 11 materials and geometry. FIGS. 3A, 3B, and 3C depict the geometry of bushing 11. Bushing 11 includes bore 11A for insertion of axle feature 13, bushing periphery 11B, and beveled surface 11C. Bore 11A may be sized such that it slides around axle feature 13 during installation, while bushing periphery 11B may be rigidly attached to wheel bore 4A and causes the bushing 11 to rotate with wheel 4. Axle feature 13 may be used to apply axial tension in the direction of central axis 16 to bearing 14, wheel shoulder 4C, and bushing 11 between axle stop 13B and nut 15. Nut 15 may be threadedly attached to the threaded feature 13B the amount of axial tension on friction device 5 may be adjusted by turning nut 15. This axial tension results in clamping the friction device 5 for a desired amount of rolling resistance of wheel 4. Beveled feature 11C allows for precise resistance adjustment.

Beveled feature 11C allows for more compression as the axial tension is increased. This is due to strain of a body caused by the amount of stress on the body. Given an axial tension and decreasing cross sectional area the stress at the smaller "beveled" end of bushing 11, the bushing deflects more causing engagement of bushing bore 11A and axle feature 13. This engagement causes friction between bushing bore 11A and axle feature 13 which in turn causes increased rolling resistance of wheel 4. In some examples, beveled feature 11C may face outward or inward.

In some examples, bushing bore 11A may be rigidly attached to axle feature 13 such that bushing 11 is not allowed to rotate with wheel 4. Bushing periphery 11A is sized such that it slides into wheel bore 4A. Applying axial tension to the friction device 5 causing the bushing periphery 11A to slide against wheel bore 4A.

Bushing 11 may consist of several different materials that effect rolling resistance and wear of friction device 5. In some examples, bushing 11 may consist of an elastomeric material that is elastic and conforms easily to surrounding parts and features. In other examples, bushing 11 may consist of metal to prevent wear. In still other examples, bushing 11 may consist of metal and elastomeric materials such that good wear resistance and conformance are obtained. Other materials may include ceramic, composite, metal alloys and woven abrasive materials. Not all features included in this example are required.

In some examples, several features may be eliminated. Bearing 14 may be excluded. Bearing 14 provides support for wheel 4, however in some examples support may be provided by an additional bushing 11. Stop feature 13B may be replaced by threaded portion and a nut. In deed any means of clamping friction device 5 along axle feature 13 may be appropriate. These means may include wedges, cams, screws and threaded holes (instead of nuts and threaded ends), linkages, and rivets.

B: Illustrative Friction Skateboard Truck with Rectangular Bushing

FIGS. 5, 5A, 5B, 5C, and 6, this section describes a friction device 505 for use in skateboard truck 3. Referring to FIG. 3 friction device 505 comprises a bearing 514, a bushing 511 and an axle feature 513. Axle feature 513 may include a nut 515 on each end or on one end. Axle feature 513B may include a threaded feature 513A. Axle feature 513 may be a part of hanger 3A or a separate part. Friction device 505 allows rotation of wheel 4 relative to hanger 3A.

In some examples of friction device 505, bearing 514 is located in wheel bore 4D. Wheel bore 4D is located at the central axis 516 of wheel cylindrical periphery 4B. Bushing 511 is located in wheel bore 4A. Wheel bore 4A may be located at the central axis 516 of wheel cylindrical periphery 4B. Axle feature 513 may include a threaded end feature 513A or a stop feature. Hanger 3A may also include a face feature 513B which locates friction device 505 axially along axle feature 513. Friction device 505 provides resistance as wheel 4 rotates around axle feature 513 while supporting board 2. This resistance can be adjusted by clamping friction device 505 along the central axis 516.

Figure 5:
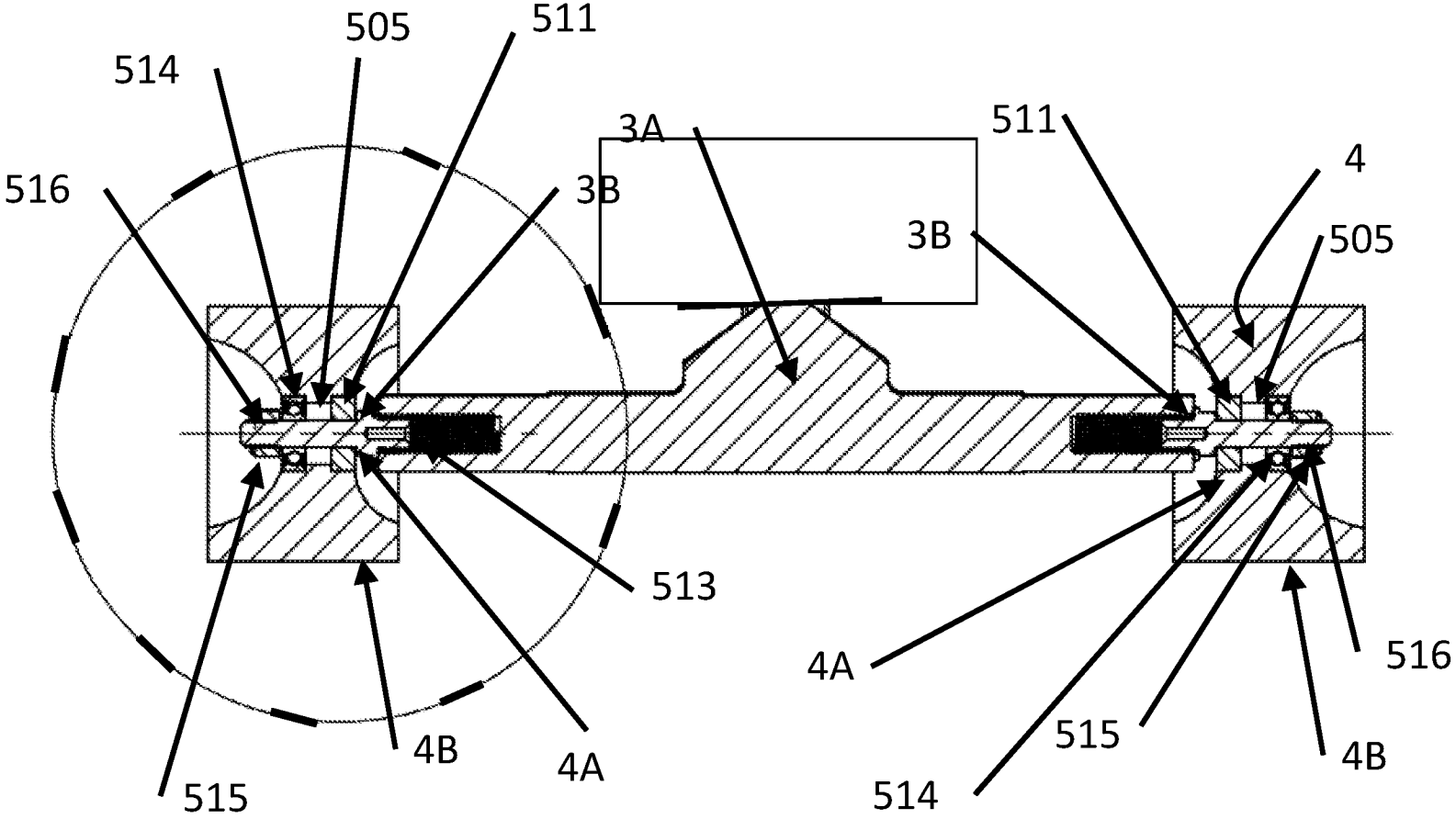
FIG. 5 depicts a cross section view indicated in FIG. 2 with a cylindrical bushing.
Figures 5A, 5B, 5C:
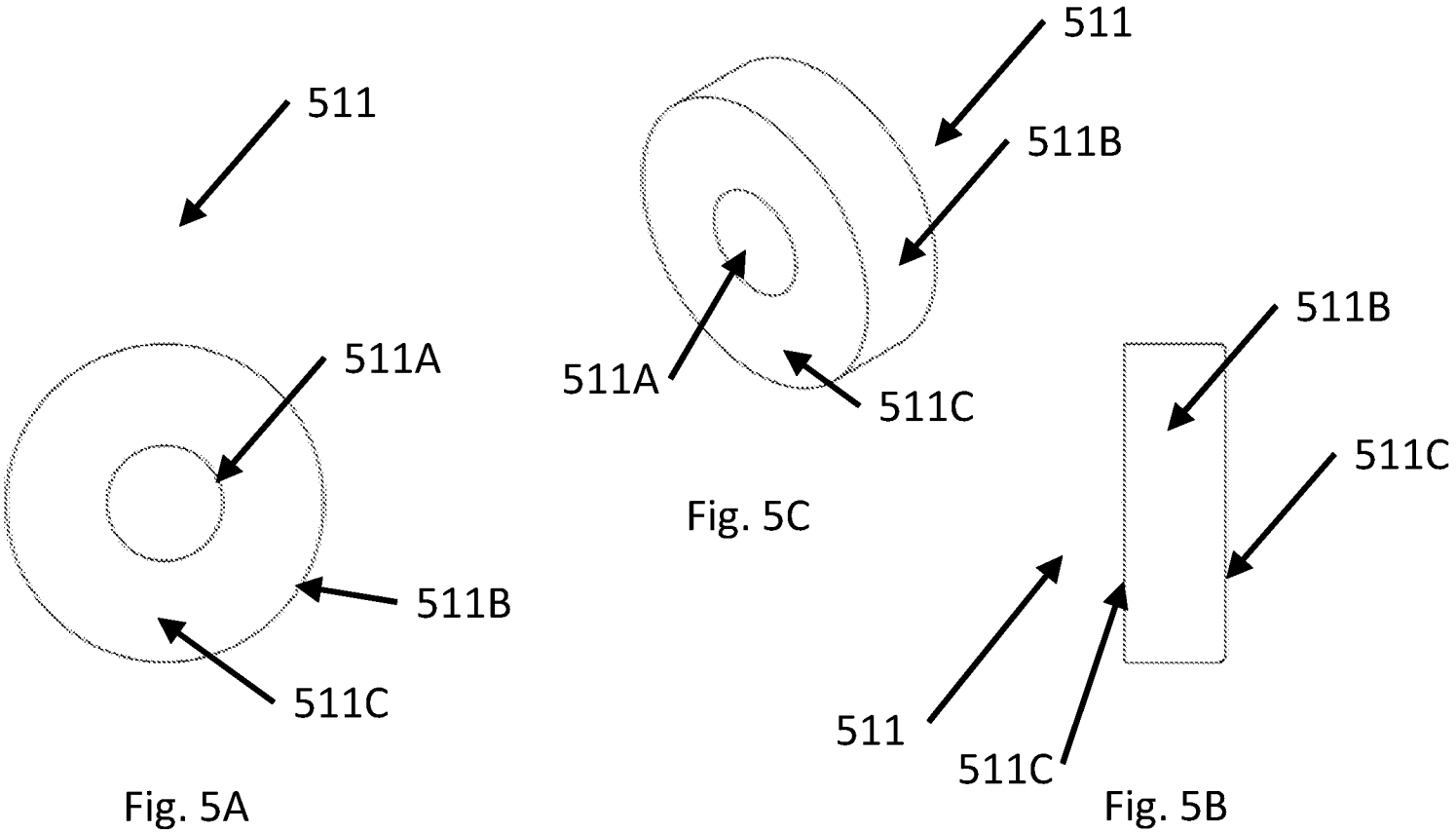
FIG. 5A depicts a front view of a cylindrical bushing.
FIG. 5B depicts a side view of a cylindrical bushing.
FIG. 5C depicts an isometric of a cylindrical bushing.
Figure 6:
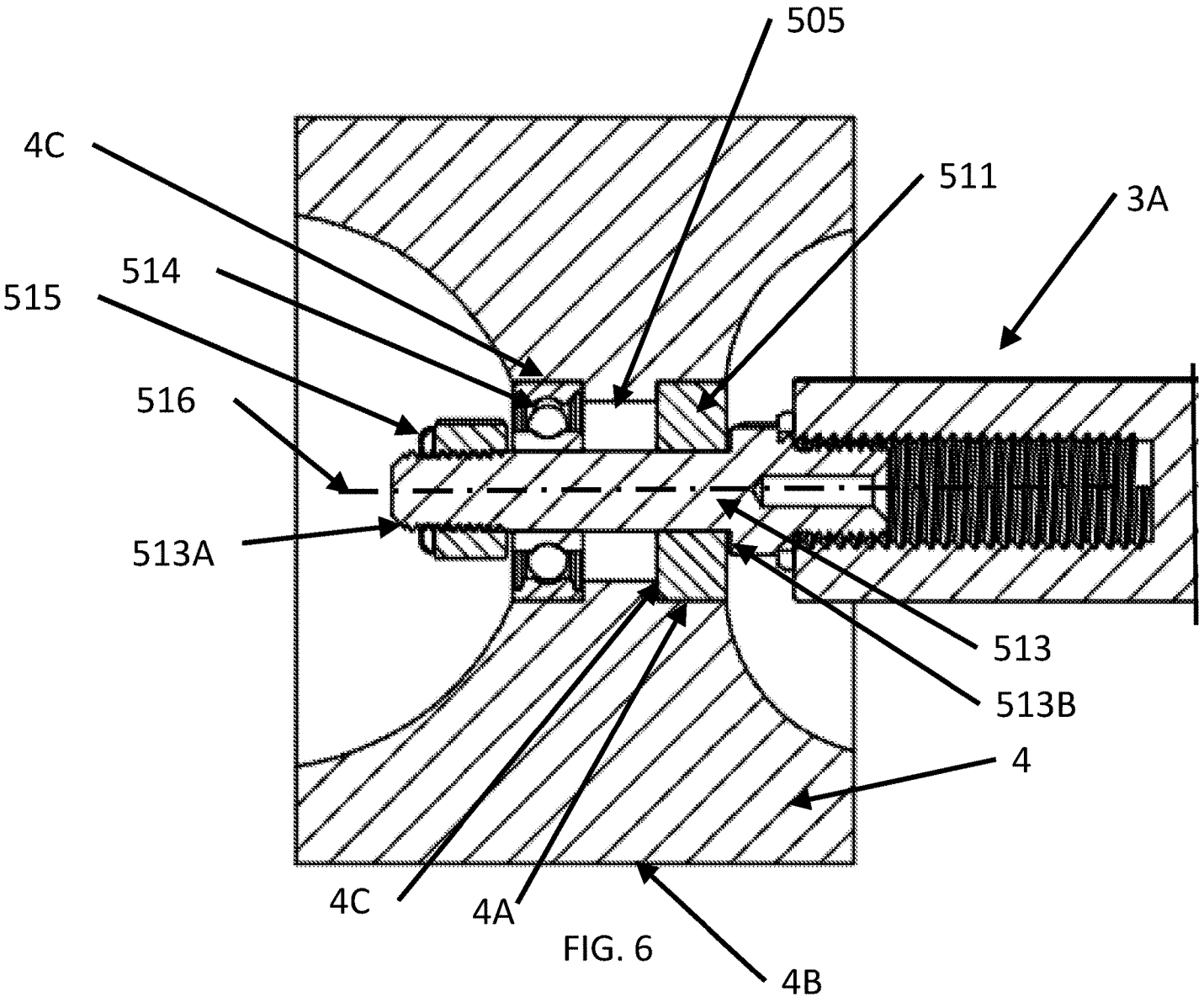
FIG. 6 depicts an enlarged detail indicated in FIG. 5.

Adjusting resistance of friction device 505 is a result of several variables including bushing 511 materials and geometry. FIGS. 5A, 5B, and 5C depict the geometry of bushing 511. Bushing 511 includes bore 511A for insertion of axle feature 513, bushing periphery 511B, and straight surfaces 511C. Bore 511A may be sized such that it slides around axle feature 513 during installation, while bushing periphery 511B may be rigidly attached to wheel bore 4A causing the bushing 511 to rotate with wheel 4. Nut 515 may be used to apply axial tension in the direction of central axis 516 to bearing 514, and bushing 511 between nut 515 and hanger surface 513B. Nut 515 may be threadedly attached to the threaded feature 513A the amount of axial tension on friction device 505 may be adjusted by turning nut 515. This axial tension results in clamping the friction device 505 for a desired amount of rolling resistance of wheel 4. Straight features 511C allows for precise resistance adjustment.

Straight feature 511C allows for constant compression as axial tension is increased. This is due to strain of a body caused by the amount of stress on the body. Given an axial tension and constant cross sectional area, the stress is constant along the length of bushing 511. Bushing 511 deflects consistently along the length of bushing 511 causing engagement of bushing bore 511A and axle feature 513. This engagement causes friction between bushing bore 511A and axle feature 513 which in turn causes increased rolling resistance of wheel 4.

In some examples, bushing bore 511A may be rigidly attached to axle feature 513 such that bushing 511 is not allowed to rotate with wheel 4. Bushing periphery 511A may be sized such that it slides on wheel bore 4A and wheel shoulder 4C. Applying axial tension to the friction device 505 causes bushing periphery 511A to slide against wheel bore 4A during use.

Bushing 511 may consist of several different materials that effect rolling resistance and wear of friction device 505. In some examples, bushing 511 may consist of an elastomeric material that is elastic and conforms easily to surrounding parts and features. In other examples, bushing 511 may consist of metal to prevent wear. In still other examples, bushing 511 may consist of metal and elastomeric materials such that good wear resistance and conformance are obtained. Other materials may include ceramic, composite, metal alloys and woven abrasive materials. Not all features included in this example are required.

In some examples, several features may be eliminated. Bearing 514 may be excluded. Bearing 514 provides support for wheel 4, however in some examples support may be provided by bushing 511. Stop feature 513B may be replaced by an additional threaded portion and a nut. In deed any means of clamping friction device 505 along axle feature 513 may be appropriate. These means may include wedges, cams, screws and threaded holes (instead of nuts and threaded ends), linkages, and rivets.

C: Illustrative Friction Skateboard Truck with Double Beveled Bushing

Figure 7:
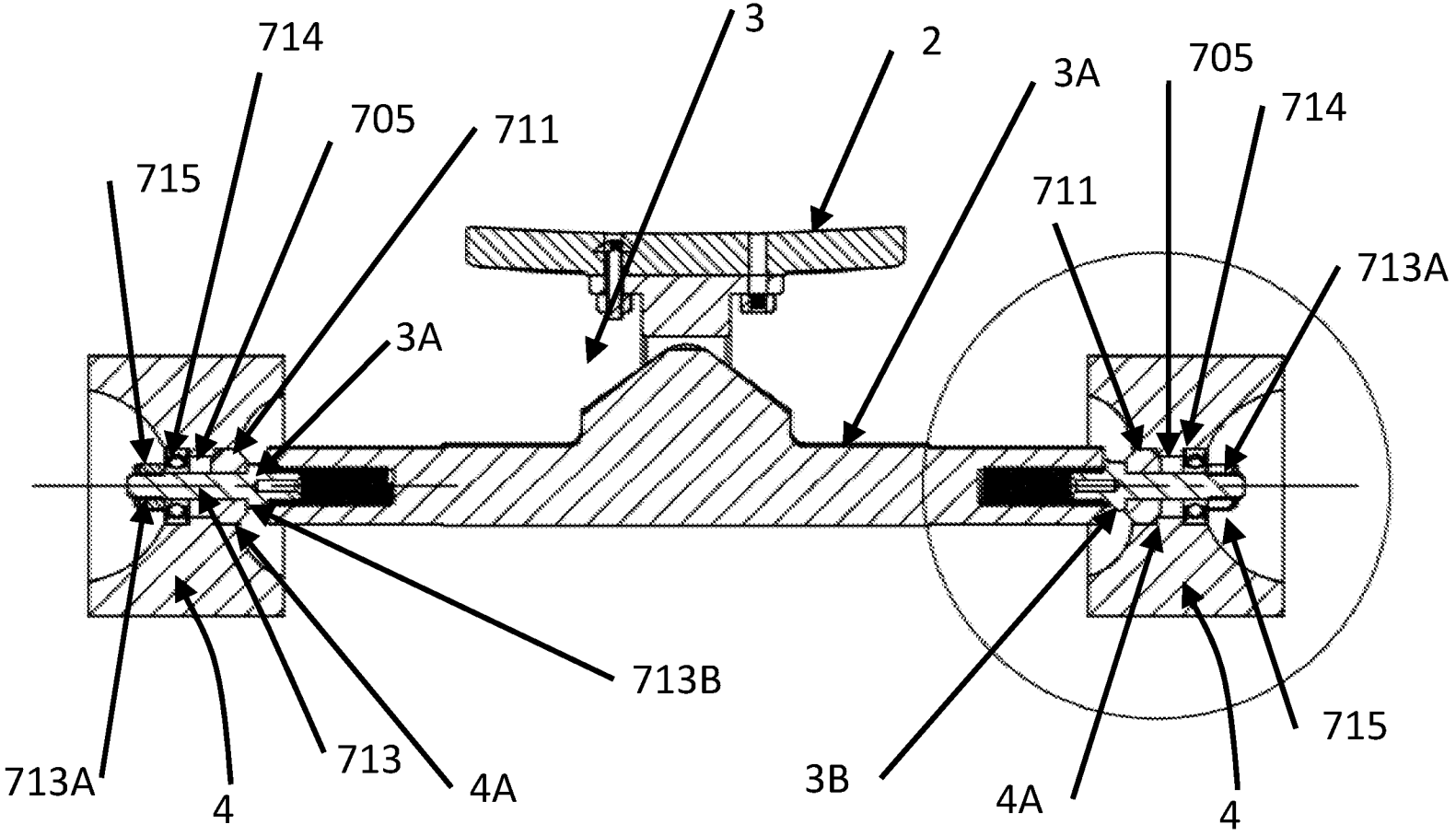
FIG. 7 depicts a cross section view indicated in FIG. 2 with a double beveled bushing.

FIGS. 7, 7A, 7B, 7C, and 8 describes a friction device 705 for use in skateboard truck 3. Referring to FIG. 7 friction device 705 comprises a bearing 714, a bushing 711 and an axle feature 713. Axle feature 713 may include a threaded end 713A and a nut 715. Axle feature 713 may include a stop feature 713B. Axle feature 713 may be a part of hanger 3A or a separate part. Friction device 705 allows rotation of wheel 4 relative to hanger 3A.

In some examples of friction device 705, bearing 714 is located in wheel bore 4D. Wheel bore 4D may be located at the central axis 716 of wheel cylindrical periphery 4B. Bushing 711 is also located in wheel bore 4A. Wheel bore 4A may be located at central axis 716. Axle feature 713 may include a threaded end feature 713A or a stop feature. Hanger 3A may also include a face feature 713B which locates friction device 705 axially along axle feature 713. Friction device 705 provides resistance as wheel 4 rotates around axle feature 713 while supporting board 2. This resistance can be adjusted by clamping friction device 705 along the central axis 716.

Figure 7B:
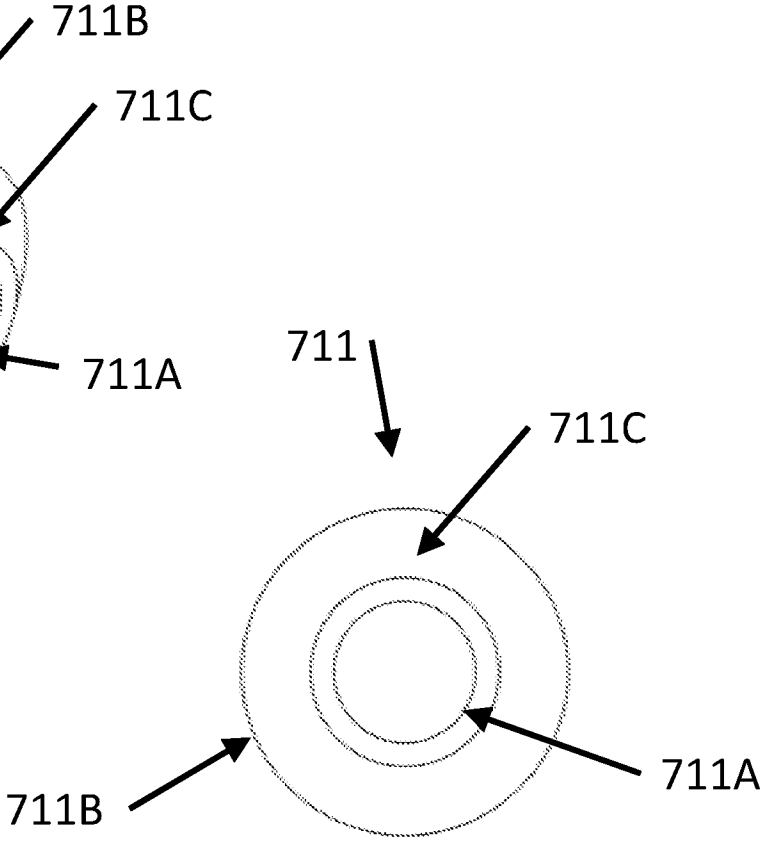
FIG. 7B depicts a side view of a double beveled bushing.
Figure 7C:
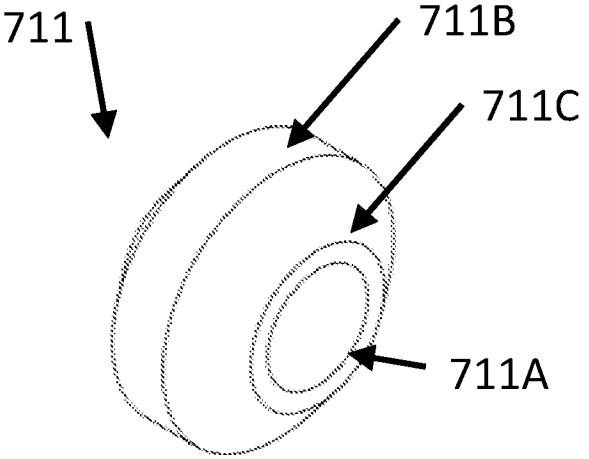
FIG. 7C depicts an isometric view of a double beveled bushing.
Figure 7A:
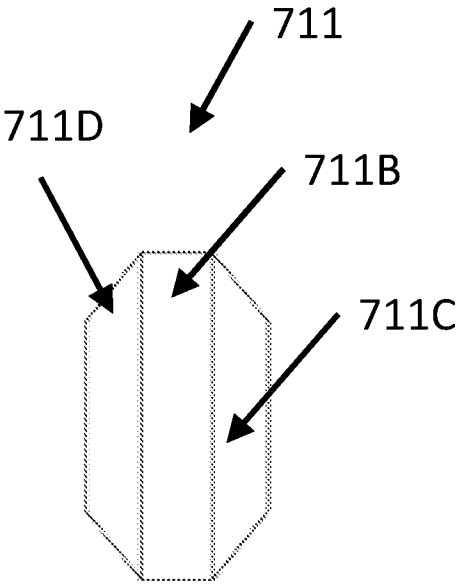
FIG. 7A depicts a front view of a double beveled bushing.
Figure 8:
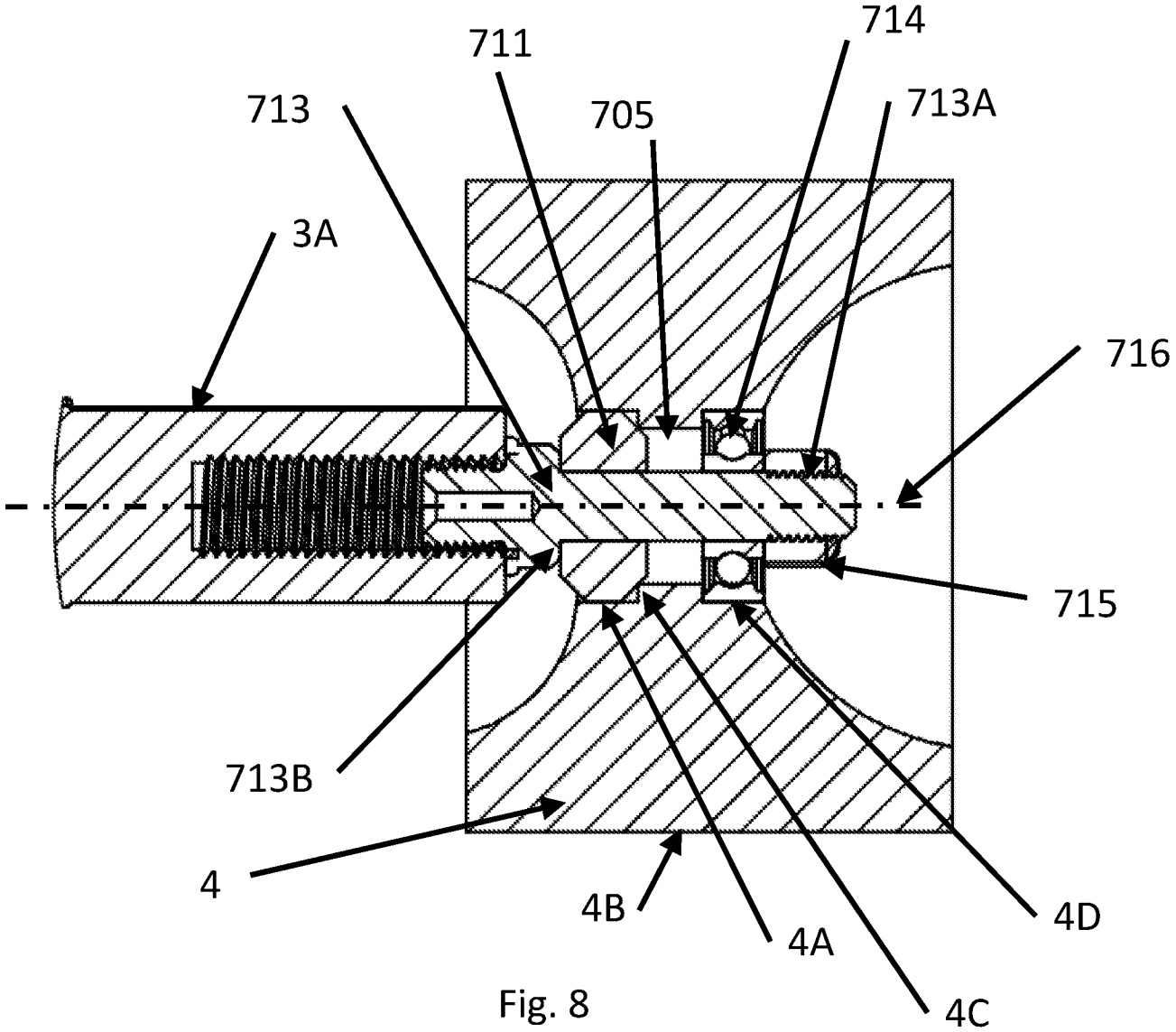
FIG. 8 depicts an enlarged detail indicated in FIG. 7.

Adjusting resistance of friction device 705 is a result of several variables including bushing 711 materials and geometry. FIGS. 7A, 7B, and 7C depict the geometry of bushing 711. Bushing 711 includes bore 711A for insertion of axle feature 713, bushing periphery 711B, and beveled surfaces 711C and 711D. Bore 711A may be sized such that it slides around axle feature 713 during installation, while bushing periphery 711B may be rigidly attached to wheel bore 4A and causing the bushing 711 to rotate with wheel 4. Axle feature 713 may be used to apply axial tension in the direction of central axis 716 to clamp bearing 714, and bushing 711 between nut 715 and hanger surface 713B. Nut 715 may be threadedly attached to the threaded feature 713B the amount of axial tension on friction device 705 may be controlled by turning nut 715. This axial tension results in clamping the friction device 705 for a desired amount of rolling resistance of wheel 4. Beveled features 711C and 711D allows for precise resistance adjustment.

Beveled features 711C and 711D allow for more compression as the axial tension is increased. This is due to strain of a body caused by the amount of stress on the body. Given an axial tension and decreasing cross sectional area the stress at the smaller "beveled" ends of bushing 711, the bushing deflects more causing engagement of bushing bore 711A and axle feature 713. This engagement causes friction between bushing bore 711A and axle feature 713 which in turn causes increased rolling resistance of wheel 4.

In some examples, bushing bore 711A may be sized such that bushing 711 is rigidly attached to axle feature 713 such that bushing 711 is not allowed to rotate with wheel 4. Bushing periphery 711A may be sized such that it slides in wheel bore 4A. Applying axial tension to friction device 705 causes bushing periphery 711A to rub against wheel bore 4A.

Bushing 711 may consist of several different materials that effect rolling resistance and wear of friction device 705. In some examples, bushing 711 may consist of an elastomeric material that is elastic and conforms easily to surrounding parts and features. In other examples, bushing 711 may consist of metal to prevent wear. In still other examples, bushing 711 may consist of metal and elastomeric materials such that good wear resistance and conformance are obtained. Other materials may include ceramic, composite, metal alloys and woven abrasive materials. Not all features included in this example are required.

In some examples, several features may be eliminated. Bearing 714 may be excluded. Bearing 714 provides support for wheel 4, however in some examples support may be provided by bushing 711. Stop feature 713B may be replaced by an additional threaded portion and a nut. In deed any means of clamping friction device 705 along axle feature 713 may be appropriate. These means may include wedges, cams, screws and threaded holes (instead of nuts and threaded ends), linkages, and rivets.

D: Illustrative Friction Skateboard Truck Adjustment Method.

Figure 9:
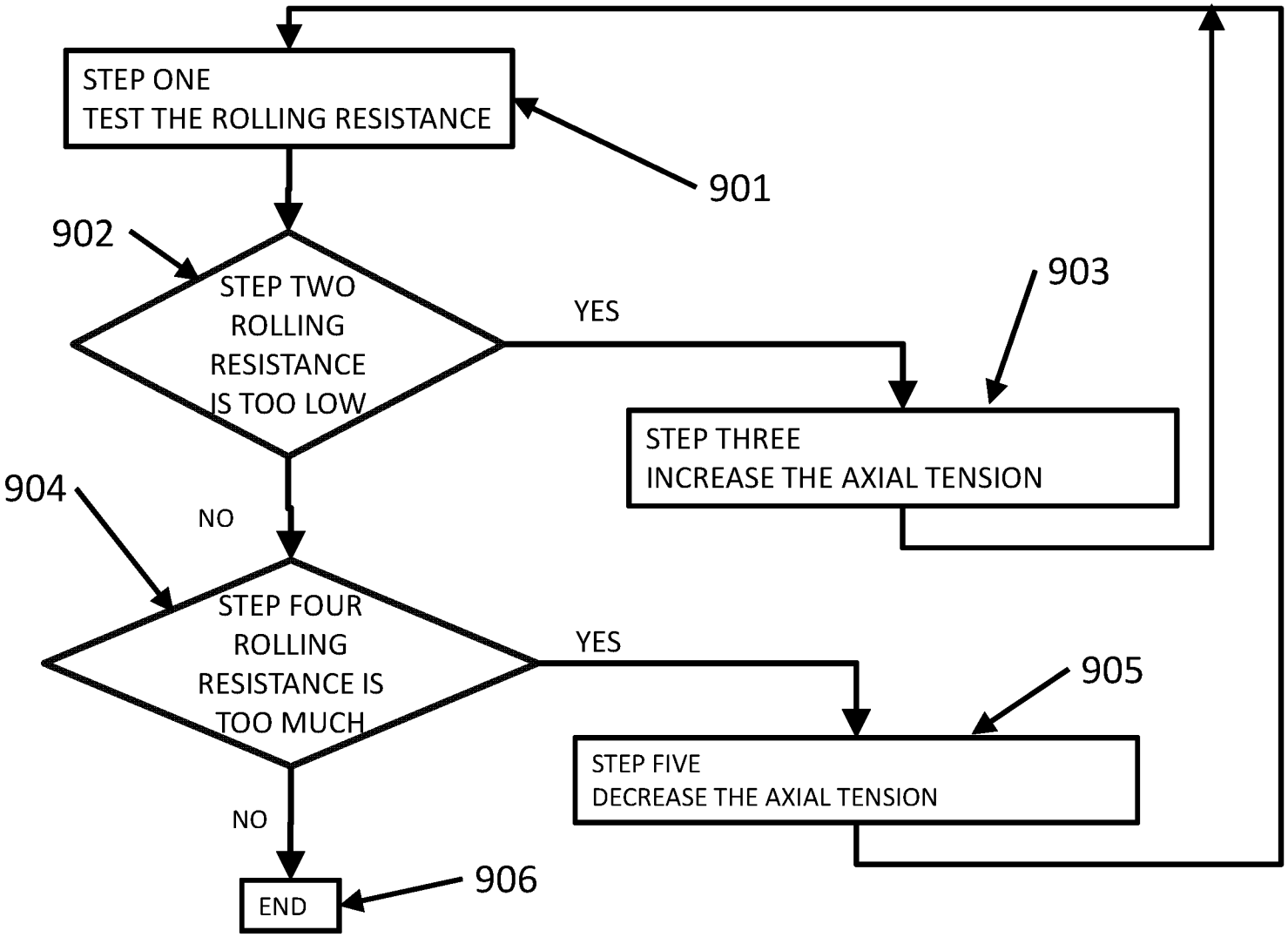
FIG. 9 depicts a flowchart of a method of adjusting rolling friction of a skateboard truck.

FIG. 9 depicts an illustrative friction skateboard truck adjustment method. Step one 901, a user tests the rolling resistance of a skateboard. This testing may include the user riding the skateboard and performing various operations. However, testing may include measuring the amount of resistance as a form of torque required to rotate wheel 4 relative to board 2. Measurements may be taken using a spring scale attached to wheel periphery 4B or with an electronic force or torque gauge appropriately attached to the wheel. Additionally, testing the rolling resistance may be include spinning wheel 4 at a specific speed. Then measuring the time it takes for wheel 4 to stop or reach a certain speed. The amount of rolling resistance is now ready for evaluation in step two.

Step two 902 determining if the rolling resistance is too low. This determination may be decided by the user. In this case it may be decided by the operator's preference. However, testing the rolling resistance by measuring torque to rotate wheel 4 may included reference to a chart for guidance. If the rolling resistance is too low, the method moves on to step three 903. However, if the rolling resistance is to high, the method moves on to step four.

Step three 903 increasing the axial tension on friction device 5, 505, or 705 is needed as the rolling friction is too low. Increasing the axial tension on friction device 5, 505, or 705 may include tightening nut 15, 515, or 715 respectively. Additionally, axial tension may be increased using wedges, cams, screws and threaded holes (instead of nuts and threaded ends), linkages, and rivets. Increasing axial tension need only increase friction between bushing 11, 511, or 711 and wheel 4. Once the axial tension has been increased the method returns to step one 901.

Step four 904 determining if the rolling resistance is too much. This determination may be decided by the user. In this case it may be decided by the operator's preference. However, testing the rolling resistance by measuring torque to rotate wheel 4 may included reference to a chart for guidance. If the rolling resistance is too high, the method moves on to step five 905. However, if the rolling resistance is not to high the method ends at 906.

Step five 905 decreasing the axial tension on friction device 5, 505, or 705 is needed as the rolling friction is too high. Decreasing the axial tension on friction device 5, 505, or 705 may include loosing nut 15, 515, or 715 respectively. Additionally, axial tension may be decreased using wedges, cams, screws and threaded holes (instead of nuts and threaded ends), linkages, and rivets. Decreasing axial tension need only decrease friction between bushing 11, 511, or 711 and wheel 4. Once the axial tension has been decreased the method returns to step one 901.

Steps one 901, two 902, three 903, four 904, and five 905 are repeated until end 906 is reached.

ADVANTAGES, FEATURES, AND BENEFITS

The different examples and examples of the skateboard truck described herein provide several advantages over known solutions for providing rolling friction to a skateboard truck. Adding friction to a skateboard truck allows an operator to learn how to operate the skateboard more easily. Learning operations may include simply riding but may include tricks such as jumps and landings.

Additionally, and among other benefits, illustrative examples described herein allow adjustment of rolling resistance a skateboard truck.

Additionally, and among other benefits, illustrative examples described herein provide a means of reducing falls while learning to ride a skateboard.

Additionally, and among other benefits, illustrative examples described herein provide a means of hiding a friction device within a skateboard wheel. This may allow the user to complete tricks that are not possible without increased rolling resistance.

CONCLUSION

The corresponding structures, materials, acts, and equivalents of all means or step plus function elements in the claims below are intended to include any structure, material, or act for performing the function in combination with other claimed elements as specifically claimed. The description of the present technology has been presented for purposes of illustration and description, but is not intended to be exhaustive or limited to the present technology in the form disclosed. Many modifications and variations will be apparent to those of ordinary skill in the art without departing from the scope and spirit of the present technology. Exemplary examples were chosen and described in order to best explain the principles of the present technology and its practical application, and to enable others of ordinary skill in the art to understand the present technology for various examples with various modifications as are suited to the particular use contemplated.

In the above description, for purposes of explanation and not limitation, specific details are set forth, such as particular examples, procedures, techniques, etc. in order to provide a thorough understanding of the present invention. However, it will be apparent to one skilled in the art that the present invention may be practiced in other examples that depart from these specific details.

Reference throughout this specification to "one example" or "an example" means that a particular feature, structure, or characteristic described in connection with the examples is included in at least one examples of the present invention. Thus, the appearances of the phrases "in one example" or "in an example" or "according to one example" (or other phrases having similar import) at various places throughout this specification are not necessarily all referring to the same examples. Furthermore, the particular features, structures, or characteristics may be combined in any suitable manner in one or more examples. Furthermore, depending on the context of discussion herein, a singular term may include its plural forms and a plural term may include its singular form.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

If any disclosures are incorporated herein by reference and such incorporated disclosures conflict in part and/or in whole with the present disclosure, then to the extent of conflict, and/or broader disclosure, and/or broader definition of terms, the present disclosure controls. If such incorporated disclosures conflict in part and/or in whole with one another, then to the extent of conflict, the later-dated disclosure controls.

While various embodiments have been described above, it should be understood that they have been presented by way of example only, and not limitation. The descriptions are not intended to limit the scope of the invention to the particular forms set forth herein. To the contrary, the present descriptions are intended to cover such alternatives, modifications, and equivalents as may be included within the spirit and scope of the invention as defined by the appended claims and otherwise appreciated by one of ordinary skill in the art. Thus, the breadth and scope of a preferred embodiment should not be limited by any of the above-described exemplary embodiments.

I claim:

1. A skateboard truck comprising;

a hanger, an axle feature having an axis fixedly attached to the hanger, a wheel having a hole supported by the axle feature, a friction device configured to attach the wheel hole to the axle feature configured to expand due to clamping along the axle axis, and allow the wheel to rotate around the axle with a resistance, and a clamping device configured to clamp the friction device along the axle axis.

2. The skateboard truck of claim 1, wherein the friction device comprises;

a bushing configured to rigidly attach to the wheel hole and expand against the axle feature due to clamping by the clamping device.

3. The skateboard truck of claim 1 wherein the friction device comprises;

a bushing configured to rigidly attach to the axle and expand against the wheel hole due to clamping by the clamping device.

4. The skateboard truck of claim 1, wherein the friction device comprises;

a bushing having two parallel ends and a hole configured to receive the axle feature.

5. The skateboard truck of claim 1, wherein the friction device comprises;

a bushing having a beveled end, a flat end, and a hole configured to receive the axle feature.

6. The skateboard truck of claim 1 wherein the friction device comprises;

a bushing having two beveled ends, and a hole configured to receive the axle feature.

7. The skateboard truck of claim 4, wherein the friction device further comprises;

a bearing configured to allow rotation of the wheel.

8. The skateboard truck of claim 5, wherein the friction device further comprises;

a bearing configured to allow rotation of the wheel.

9. The skateboard truck of claim 2, wherein the bushing is configured to expand and increase the resistance against the axle as a result of the clamping the friction device.

10. The skateboard truck of claim 3, wherein the bushing is configured to expand and increase the resistance against the wheel hole as a result of clamping the friction device.

11. The skateboard truck of claim 4, wherein the clamping device is configured to apply force to the two bushing flat ends such that the resistance is adjusted.

12. The skateboard truck of claim 5, wherein the clamping device is configured to apply force to the beveled end and the flat end of the bushing such that the resistance is adjusted.

13. The skateboard truck of claim 6, wherein the clamping device is configured to apply force to the beveled ends of the bushing such that the resistance is adjusted.

14. The method of adjusting the resistance of a skateboard truck, wherein the skateboard truck comprises;

a hanger, an axle feature fixedly attached to the hanger, a wheel having a hole supported by the axle feature, a friction device configured to attach the wheel hole to the axle feature and allow the wheel to rotate around the axle with a resistance, and a clamping device configured to clamp the friction device to the axle, the method comprising;

clamping the friction device such that a force is applied along the axle and through the friction device, testing the resistance, and adjusting the force to create the desired resistance.

15. A skateboard truck comprising;

a hanger, an axle feature fixedly attached to the hanger, a wheel having a hole supported by the threaded axle feature, a friction device configured to attach the wheel hole to the axle feature and allow the wheel to rotate around the axle with a resistance the friction device further comprising a bushing configured to rub against the axle as the wheel rotates and a bearing configured to allow the wheel to rotate and support radial forces applied to the wheel, and a clamping device configured to clamp the friction device to the axle.

16. The skateboard truck of claim 15, wherein the clamping device is a threaded nut and the axle is threaded and further configured to receive the threaded nut and clamp the friction device.

17. A skateboard truck comprising;

a hanger, an axle feature fixedly attached to the hanger, a wheel having a hole supported by the threaded axle feature, a friction device configured to attach the wheel hole to the axle feature and allow the wheel to rotate around the axle with a resistance, the friction device further comprising a bushing configured to rub against the wheel hole as the wheel rotates and a bearing configured to allow the wheel to rotate and support radial forces applied to the wheel, and a clamping device configured to clamp the friction device to the axle.

* * * * *